US008580100B2

(12) United States Patent
Feng et al.

(10) Patent No.: US 8,580,100 B2
(45) Date of Patent: Nov. 12, 2013

(54) METAL DEPOSITION USING SEED LAYERS

(75) Inventors: Hsien-Ping Feng, Watertown, MA (US); Gang Chen, Carlisle, MA (US); Yu Bo, Chesnut Hill, MA (US); Zhifeng Ren, Newton, MA (US); Shuo Chen, Newton, MA (US); Bed Poudel, Newtonville, MA (US)

(73) Assignees: Massachusetts Institute of Technology, Cambridge, MA (US); The Trustees of Boston College, Chestnutt Hill, MA (US); GMZ Energy, Inc., Waltham, MA (US)

( * ) Notice: Subject to any disclaimer, the term of this patent is extended or adjusted under 35 U.S.C. 154(b) by 231 days.

(21) Appl. No.: 12/932,372

(22) Filed: Feb. 24, 2011

(65) Prior Publication Data

US 2012/0217165 A1 Aug. 30, 2012

(51) Int. Cl.
*C25D 5/02* (2006.01)
*C25D 5/54* (2006.01)

(52) U.S. Cl.
USPC ..... 205/135; 205/162; 205/118

(58) Field of Classification Search
USPC ..... 106/1.22, 1.27; 427/77; 216/51, 67, 77; 205/143, 291, 292, 148, 80, 135, 136, 205/162
See application file for complete search history.

(56) References Cited

U.S. PATENT DOCUMENTS

| | | | | |
|---|---|---|---|---|
| 7,271,094 | B2 * | 9/2007 | Conrad | 438/671 |
| 7,838,065 | B2 | 11/2010 | Wei et al. | |
| 2006/0202392 | A1 * | 9/2006 | Zheng | 264/400 |
| 2008/0063788 | A1 * | 3/2008 | Wei et al. | 427/77 |
| 2009/0139868 | A1 * | 6/2009 | Shrader et al. | 205/118 |
| 2011/0101532 | A1 * | 5/2011 | Pohl et al. | 257/758 |

FOREIGN PATENT DOCUMENTS

WO WO 2009142497 A1 * 11/2009

OTHER PUBLICATIONS

Triangular lattice of carbon nanotube arrays for negative index of refraction and subwavelength lensing effect Y. Wang, X. Wang, J. Rybczynski, D. Z. Wang, K. Kempa, and Z. F. Ren, Appl. Phys. Lett. 86, 153120 (2005).*
Charbonnier et al., Suf. Coat. Technol. 2002, 162, 19.
Staikov, et al., Surf. Sci., 1991, 248, 234.
Grujicic et al., Electrochimica Acta, 2002, 47, 2901.
Budevski et al., Electrochimica Acta, 2000, 45, 2559.
Dellmann et al., Sensors and Actuators, 1998, 70, 42.
Sugioka et al., App. Phys. Lett., 1989, 55, 619.
Scheck et al., App. Phys. Lett., 2005, 86, 133108.
Pathak et al., Chem. Mater., 2000, 12, 1985.
Wei et al., J. Phys. Chem C, 2007, 111, 4847.
Poudel et al., Science, 2008, 320, 634.

(Continued)

*Primary Examiner* — Luan Van
*Assistant Examiner* — Louis Rufo
(74) *Attorney, Agent, or Firm* — Nutter McClennen & Fish LLP

(57) ABSTRACT

Methods of forming a conductive metal layers on substrates are disclosed which employ a seed layer to enhance bonding, especially to smooth, low-roughness or hydrophobic substrates. In one aspect of the invention, the seed layer can be formed by applying nanoparticles onto a surface of the substrate; and the metallization is achieved by electroplating an electrically conducting metal onto the seed layer, whereby the nanoparticles serve as nucleation sites for metal deposition. In another approach, the seed layer can be formed by a self-assembling linker material, such as a sulfur-containing silane material.

15 Claims, 14 Drawing Sheets

(56) References Cited

OTHER PUBLICATIONS

Pettes et al., International Conference on Thermoelectrics, 2007, 283.
daSilva et al., J Heat and Mass Transfer, 2004, 47, 2417.
Mengali et al., Advanced Energy Conversion, 1962, 2, 59.
Muto et al., Review of Scientific Instruments, 2009, 80, 093901.
Lewis et al., Appl. Phys. Lett., 2008, 92, 062113.
Datta et al., J. Electrochem. Soc., 1995, 142, 3779.
Cooper et al., IBM, J. Res. Develop., 2005, 49, 103.
Shafarman et al., Handbook of Photovoltaic Science and Engineering John Wiley, pp. 567-616, 2003.
Lincot et al., Solar Energy, 2004, 77, 725.
Feng et al., Electrochemica Acta, vol. 56, pp. 3079-3084, 2011.
Bexell, Comprehensive Summaries of Uppsala Dissertations from the Faculty of Science and Technology 843, pp. 1-59, 2003.

* cited by examiner

FIG. 10A RMS=21.73 nm
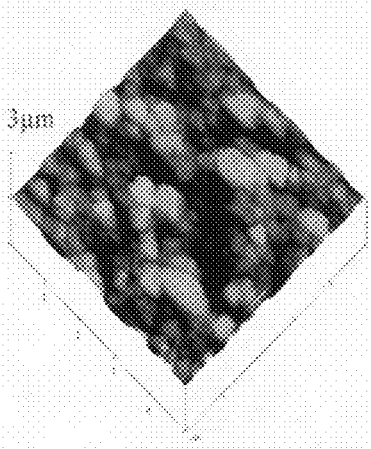
FIG. 10C
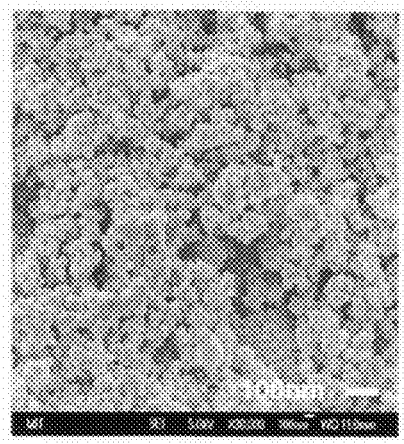
FIG. 10B
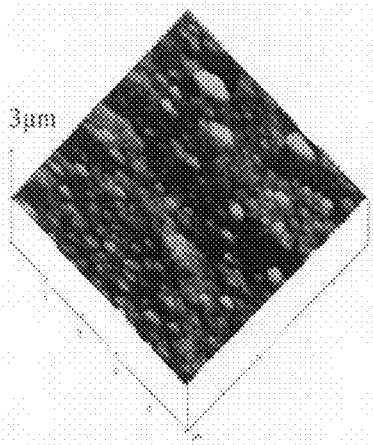
FIG. 10D
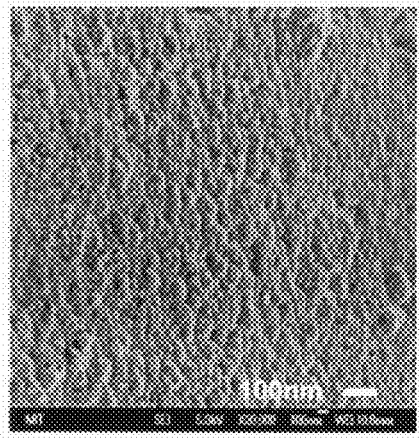

METAL DEPOSITION USING SEED LAYERS

STATEMENT REGARDING U.S. GOVERNMENT RIGHTS

This invention was made with U.S. government support under Grant No. DE-FG02-08ER46516, awarded by the U.S. Department of Energy. The Government has certain rights in this invention.

BACKGROUND OF THE INVENTION

Metallization is the process of depositing metal material on the surface of a substrate. Electroplating and other forms of electro-deposition are commonly used metallization techniques to form electrical conductive contacts or protective coatings. For example, electroplating is used in ultra large-scale integration (ULSI) to provide multiple levels of copper or copper alloy metallization.

Metallization is also used in the fabrication of optoelectronic devices such as transparent thin film transistors (TFT), flat panel displays, light-emitting diodes (LED), photovoltaic cells, and electrochromic windows to provide interconnects for transparent device-to-device integration. In the case of electrochromic window fabrication, substrates are typically semiconductors or transparent conductive oxides (TCO), e.g. zinc oxide, indium-tin oxide, and fluorine-doped tin oxide. Furthermore, electroplating is used in the fabrication of power electronics for the metallization of ceramic substrates.

The fabrication of thermoelectric devices or device components also requires metallization on semiconductor substrates. Thermoelectric devices are uniquely advantageous in heat removal and energy harvesting applications because they are free of moving parts, acoustically silent, and they can be integrated into microelectronic devices. Recent advances have greatly improved the thermoelectric figure-of-merit (ZT) of nanostructured thermoelectric alloys. In particular, nanostructured p-type bismuth antimony telluride has achieved a peak figure-of-merit (ZT) of about 1.4 at 100° C.

However, these material property advances have not fully translated into better overall performance in the thermoelectric devices due at least in part to variations in the thermal and electrical contact resistances between the nanostructured alloy substrates and the metallized electrodes. A poorly formed contact generates localized Joule heating effects and leads to a non-uniform current distribution which lowers an effective figure-of-merit ($ZT_{eff}$) for the thermoelectric device from that of the thermoelectric material.

Generally, in the fabrication of electronic devices, thermoelectric devices, and other metallization processes, desirable electrical and thermal contact properties are highly correlated with a uniform deposition of the metallic atoms on the substrate which creates a strong adhesion and an effective interface between the deposited metal layers and the substrate. In particular, the process of electroplating metal depends on a nucleation process, which is determined by the formation energy, excess energy, and internal strain energy of the phase transition during metallization.

Direct electroplating on smooth, low-roughness, or hydrophobic surfaces of glass, semiconductor, or ceramic substrates is difficult because the target surface has low surface energy or poor wettability, which leads to a relatively high excess energy for electroplating nucleation. As a consequence, scattered and irregular grains of metal grow on a small number of nucleation sites, causing poor interfacial adhesion and large surface roughness. A further consequence of the scattered and irregular grain formation is that strain energy, which is caused by a different atomic arrangement between two adjacent metallization layers, increases with increasing overall metallization thickness, and can sometimes cause metallization layers to spontaneously peel off.

Furthermore, for many applications, metallization is desired on only a portion of the substrate surface, e.g., to form an electrical contact at a specific location. Here, additional processes are typically employed prior to the electroplating process to achieve a selective metallization. For example, a patterning process can be used to form a masking pattern layer on a selected region or regions on the surface of the substrate.

In one commonly used approach to selective metallization, photolithography is employed to create a patterned photoresist layer on the substrate. The exposed regions (the portions not covered by the photoresist mask) can then be etched to create additional surface roughness (or simply to expose the area for metal deposition). Metal can then be sputtered onto the exposed (and etched) regions. These processes improve both the adhesion and electrical conductivity of the primary structure constructed by the subsequent electroplating process. Following the electroplating process, an additional chemical mechanical polishing process can be used to remove any surplus metal and planarize the entire surface. Finally, the photoresist is removed.

Although photolithography and other similar techniques can achieve selective metallization with a high degree of precision, these techniques require costly specialized equipments and can significantly hinder device production rates.

There exists a need for better metallization techniques, especially techniques that can be used on smooth, low-roughness or hydrophobic substrates to achieve high quality metal layers with strong adhesion. Metallization techniques that can achieve selective metallization without the complexity of photolithography would also satisfy a long felt need in the art.

SUMMARY OF THE INVENTION

Methods of forming a conductive metal layers on substrates are disclosed which employ a seed layer to enhance bonding, especially to smooth, low-roughness or hydrophobic substrates. In one aspect of the invention, the seed layer can be formed by applying nanoparticles onto a surface of the substrate; and the metallization can be achieved by electroplating an electrically conducting metal onto the seed layer, whereby the nanoparticles serve as nucleation sites for metal deposition. In another approach, the seed layer can be formed by a self-assembling linker material, such as a sulfur-containing silane material.

The methods of the present invention can be particularly effective to provide metallization to substrate surfaces that are characterized by at least one of the following characteristics: low surface energy, poor wettability, a hydrophobic surface, a glass (or glass-like) composition or low surface roughness.

When nanoparticles are used as the linker material, the nanoparticles can be applied as a complex with an immobilizing carrier. Following application the complex can be annealed or heated to essentially sinter the nanoparticles onto the surface of the substrate. In one embodiment, the complex can be a complex of polymer encased nanoparticles in which the polymer can be at least one polymer selected from poly (vinylpyrrolidone) (PVP), poly(acrylamide) (PAM), poly(vinyl alcohol) (PVAL), poly(acrylic acid) (PAA), and poly(ethyleneimine) (PEI).

In certain preferred embodiments, the nanoparticles can be metal nanoparticles, e.g., having a composition that includes at least one metal selected from the group of platinum, gold, palladium, ruthenium, silver, titanium, tantalum, tungsten, aluminum, chromium, cobalt, nickel, and their respective alloys. In some applications the method can further include a pre-treatment step of contacting the substrate with a surfactant, e.g., a cationic surfactant, prior to depositing the seed layer.

The methods of the present invention, especially when metallic nanoparticles are used, can also be effective in selective metallization of portion of a substrate by selectively applying a seed layer to a portion of the surface and then preferentially depositing the electrically conducting metal on the selectively applied seed layer. For example, the seed layer can be selectively applied to a portion of the surface by employing photolithography, screen printing, inkjet printing, micro-contact stamping or dip-pen nanolithography or combinations of such techniques. In certain preferred embodiments, the seed layer can be selectively applied to a portion of the surface by first applying a mask layer on a substrate surface thereby exposing only a predetermined portion of the substrate surface for applying the seed layer. The step of preferentially depositing the electrically conducting metal can be enhanced by selecting a voltage at which electrically conduction material can be preferentially (or only) deposited on the selectively applied seed layer.

The present invention also encompasses methods of a chemically modifying the substrate with a linker material, such as a sulfur or halogen containing silane. In some embodiments, such chemical linkers can be applied to self-assemble into a monolayer of linker material. For example the linker material can be a sulfur-containing silane material such as (3-mercaptopropyl-trimethoxysilane) (3-Mercaptopropyl) methyldimethoxysilane, (3-Mercaptopropyl)triethoxysilane, 3-Mercaptopropyl-functionalized silica gel, (3-Chloropropyl)trimethoxysilane, (3-Bromopropyl)trimethoxysilane, or (3-Iodopropyl)trimethoxysilane. In one preferred embodiment, the sulfur-containing silane material includes (3-mercaptopropyl-trimethoxysilane) (MPS).

The methods of the present invention can be used to provide metallization with a wide variety of metals, including for example, one or more of the following metals: titanium, tantalum, tungsten, aluminum, chromium, nickel, cobalt, silver, gold, copper, and their alloys.

BRIEF DESCRIPTION OF THE DRAWINGS

FIGS. 10A-D are SEM and AFM images confirming the metal deposition performed according to the method shown in FIGS. 8A-8C;

DETAILED DESCRIPTION

Figure 1A:
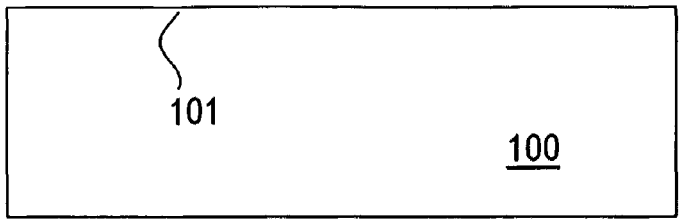
FIGS. 1A-1C illustrate a method of metal deposition using a seed layer according to the invention.

The following definitions provide additional context for the detailed descriptions that follow and are not intended to limit the scope of the detailed descriptions.

The term "substrate" as used herein is intended to encompass electronic materials, such as semiconductor and thermoelectric materials, as well as inert materials, such as glasses, ceramics and dielectrics.

The term "surface" as used herein is intended to encompass an entire surface of a substrate or a selected region of the substrate. For example, the seed layers described herein may be selectively deposited onto regions of the substrate to form discontinuous surfaces for selective metallization.

The term "metal" as used herein is intended to encompass elemental metals and metal alloys, as well as metallic compounds and metal precursors that can be used to form a conductive contacts and/or nanoparticles.

The term "self-assembling polymer" as used herein is intended to encompass any polymer that arranges in an ordered state as a solution of the polymer approaches equilibrium, thereby reducing its free energy. Examples include: 3-mercaptopropyl-trimethoxysilane (MPS), (3-Mercaptopropyl)methyldimethoxysilane, (3-Mercaptopropyl)triethoxysilane, 3-Mercaptopropyl-functionalized silica gel, (3-Chloropropyl)trimethoxysilane, (3-Bromopropyl)trimethoxysilane, (3-Iodopropyl)trimethoxysilane.

The term "grain homogeneity" as used herein is used to describe a measure of microstructural uniformity of regularity in grain boundary, grain size, or crystalline geometry The term "linker material" as used herein is used to describe molecules, monomer, or functional groups on molecules or monomers that provide chemical bond or electrical affinity between neighboring molecules or monomers.

The term "bifunctional linker" as used herein is used to describe any molecule or monomer that has two functional groups, or binding sites, or has affinity for two groups of atoms or molecules.

The term "electrically conducting linker material" as used herein is used to describe a molecule or monomer that conducts electron into a reaction center thereby stabilizes an electron deficient molecule or monomer, for example, a cation.

The term "self-assembled monolayer" as used herein is used to describe an organized layer of amphiphilic molecules in which one end of the molecule, the "head group," provides a special affinity for a substrate, and in which a second end of the molecule, the "tail group," provides a functional group as a terminal end. The SAM is created by the chemisorption "head groups" onto a substrate from either the vapor or liquid phase followed by a substantially planar organization of "tail groups".

In the fabrication of semiconductor and/or thermoelectric devices, conventional metallization techniques such as sputtering and electroplating are problematic in a number of aspects. In the case of sputtering, conventional methods require costly vacuum equipments and results in a low production rate. For example, the most widely used thermoelectric materials near room temperature, bismuth telluride and its alloys ($Bi_2Se_yTe_{3y}$ as the n-type, $Bi_2Sb_{2x}Te_3$ as the p-type), form complex semiconductor-to-metal interfaces. These $Bi_2Te_3$-based alloys are small bandgap thermoelectric semiconductors with a low melting point (573 C), a low surface energy (hydrophobic), and a low resistivity (100-1000 μΩ-cm). In theory, the small bandgap property (0.11-0.16 eV) provides an ohmic contact with a low specific contact resistance (10 e-7 Ohm $cm^2$), which are ideal properties for the fabrication of a semiconductor-to-metal contact. However, the hydrophobic property of the substrate surface requires an additional thin layer to improve adhesion. For example, chromium is typically applied by sputtered before a nickel contact is deposited onto $Bi_2Te_3$-based alloys. The surface of nanostructured $Bi_2Te_3$-based alloys exhibit several times more grain boundaries and a disordered orientation than bulk material, thereby presenting a broad and chaotic distribution of surface energy that is unfavorable to subsequent metallization.

As a result of the above problems with sputtering techniques, electrochemical deposition is widely use instead. However, all of commonly used electrochemical deposition techniques, electroplating techniques, and electroless plating techniques results in poor metallization on semiconductor substrates.

In the case of electroplating techniques, thermoelectric semiconductors, such as $Bi_2Te_3$-based alloys have a lower surface energy than metals leading to a poor wettability and a higher nucleation formation energy. The resulting scattered growth of nuclei on a small number of nucleation sites cause weak interface contact and poor adhesion. Nanostructured surfaces can have more nucleation sites for electroplating, however, the broad distribution of surface energy can cause electroplating nucleation to be more uneven.

In the case of electroless plating techniques, nickel is plated on $Bi_2Te_3$-based substrates by using an initial coating of palladium-tin catalyst. However, this method results in a relatively high contact resistivity because unwanted impurities (the palladium-tin used as a plating catalyst, the reducing agent, and the chelating agent) and structural imperfections accumulate at the interface. For $Bi_2Te_3$-based alloys, the acidic solution of the palladium-tin catalyst also oxidizes and corrodes the substrate surface according to the Pourbaix diagram. These nanostructured surfaces are particularly susceptible to damage at their weak points in the grain boundaries.

A third approach, direct electroplating, is a hybrid method that utilizes aspects of both electroplating and electroless plating techniques to deposit metal on a nonconductor or semiconductor. Direct electroplating starts by coating an activated palladium and further enhances the activated palladium colloid by dipping the colloid in a sulfide-containing solution. The presence of sulfide forms a link between the metal ions and the palladium, thereby allowing electrical current to pass during electroplating. Other compounds with the electron bridging property similar to sulfide can be used as such electroplating promotion agent. Unfortunately, the palladium-tin colloids used in these direct electroplating methods remain as sources of structural weakness, as discussed in the case of electroless plating.

Figure 1B:
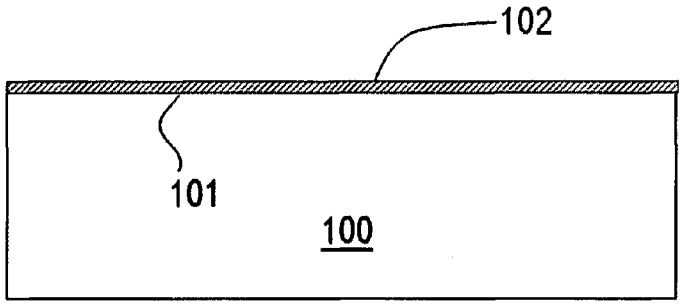
Figure 1C:
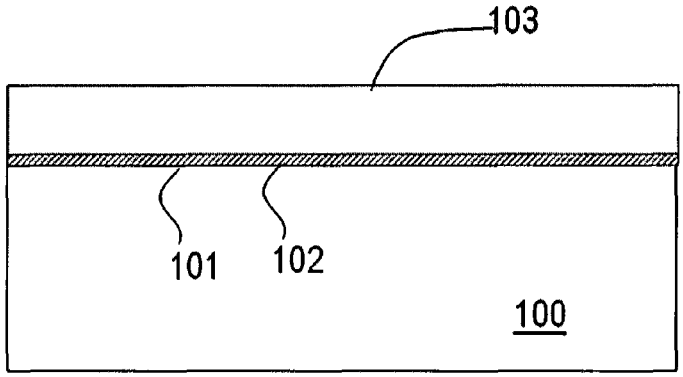

Accordingly, better techniques for metallization are desired. In one aspect of the present invention, nanoparticles are used to provide a seed layer for metal deposition. As shown in FIGS. 1A-1C, a substrate 100 for metal deposition can be a fluorine-doped tin oxide (FTO) glass. A cut piece of FTO of 1 $cm^2$ in area and 2 mm in thickness have the physical characteristics of a sheet resistance of 10 Ω/square, a resistivity of 350 μΩcm, a band gap potential of 3.8 eV, and an optical transmissivity of 90%.

First, as shown in FIG. 1A, a deposition surface 101 of the FTO glass substrate 100 can be cleaned. According to one preferred embodiment, the FTO glass substrate 100 can be immersed in a solution of 2% PK-LCG545 (Parker Corp.) at 50° C. for 5 minutes with sonication to clean the deposition surface 101.

Next, as shown in FIG. 1B, the deposition surface 101 can be pretreated by depositing a seed layer of nanoparticles 102. According to a preferred embodiment, a layer of a nanoparticles complex in an immobilizing carrier can be deposited onto the deposition surface 101 by immersing the substrate in a solution of surfactants followed by immersing the substrate in a solution of immobilized nanoparticles complexes. Further according to the preferred embodiment, the substrate 100 can be immersed in a 1% surface conditioner (2-(2-Aminoethylamino) ethanol, AEEA) at 45° C. for 5 minutes, and then immersed in a solution of PVP-capped platinum nanoclusters suspension at room temperature for 5 minutes.

Here, platinum nanoparticles can be used because platinum can be an inert metal and its suspension can be readily prepared without additional purification. Although platinum nanoparticles are used in the preferred embodiment, other nanoparticle materials can be used to provide a seed layer of nanoparticles.

The PVP-capped platinum nanoclusters can be synthesized by the following procedure: forming a PVP solution by dissolving 0.1 grams Poly-N-vinyl-2-pyrrolidone (PVP) (MW=8000) in 44 ml deionized water at room temperature in a beaker with stirring; adding a precursor of $H_2PtCl_6$ (0.2 grams) to the PVP solution, thereby obtaining a ratio of weight of polymer (PW) to a weight of noble metal (MW) of about 1.1; finally, adding a 5 ml reductant (0.5M $NaBH_4$ solution) slowly to the solution. The solution quickly changes from yellowish to black, indicating the formation of Pt nanoclusters. The whole procedure can be performed at room temperature within 30 minutes.

Next, the deposition surface 101 and the seed layer 102 of nanoparticles thereon are annealed to sinter the seed layer of nanoparticles, thereby form a pretreated deposition surface.

According to a preferred embodiment, the pretreated deposition surface 101 can be annealed at 250° C. for 10 minutes at ambient conditions to sinter the platinum nanoparticles and to burn away the protective PVP-polymers.

Next, as shown in FIG. 1C, a metal material can be electroplated onto the pretreated deposition surface 101 to form a metallization layer 103. According to a preferred embodiment, Nickel can be electroplated onto the pretreated deposition surface 101 within an optimum range of the operating voltage from a commercial electrolyte at 53° C. Other metals can be electroplated onto the pretreated deposition surface, for example, copper, tin, and gold can be similarly electroplated at room temperature.

Figure 2A:
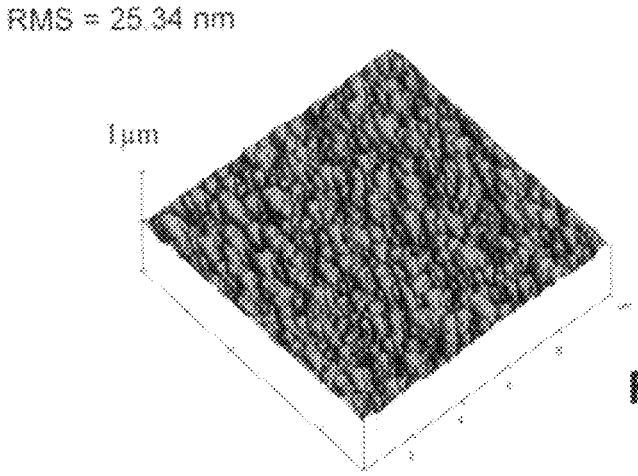
FIGS. 2A-2C are atomic force microscopy (AFM) images demonstrating metal deposition according to the invention.
Figure 2B:
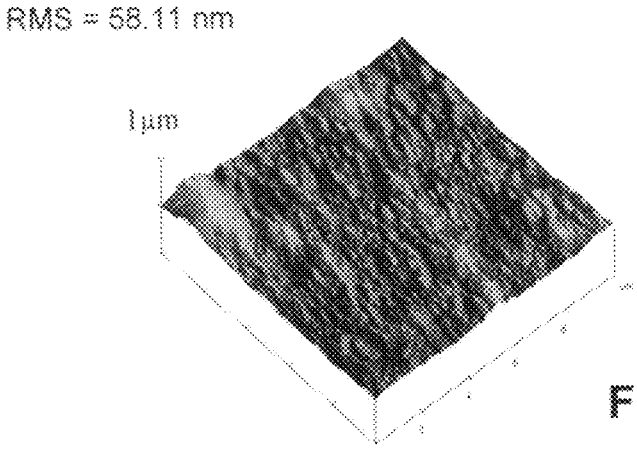
Figure 2C:
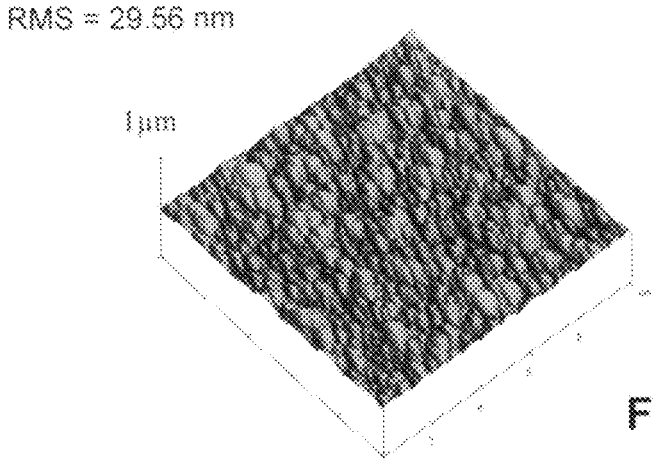

FIGS. 2A-2C are images of atomic force microscopy (AFM) which confirm the metal deposition as described above. In particular, FIG. 2A is an AFM image of an untreated FTO substrate surface. FIG. 2B is an AFM image of an approximately 100 nm layer of nickel electroplated on an untreated FTO substrate surface. Finally, FIG. 2C is an AFM image of an approximately 100 nm layer of nickel electroplated on a FTO substrate pretreated with a seed layer of platinum nanoparticles. The AFM images are produced with a scan size of 10 μm and a scan rate of 1 Hz. The scale on the z-axis is 1 μm/div and the scale on the x-axis is 2 μm/div.

A root-mean-square (RMS) thickness measurement can be made in each of the AFM images in FIGS. 2A-2C. Specifically, FIG. 2A depicts an untreated substrate having an RMS thickness of 25.34 nm. FIG. 2B depicts an untreated substrate having an RMS thickness of 58.11 nm after deposition. Finally, FIG. 2C depicts a pretreated substrate having an RMS thickness of 29.56 nm after deposition. In particular, FIGS. 2A and 2C show that the RMS value of roughness of the electroplated substrate can be made substantially the same as the untreated substrate. Therefore, the above-discussed method of providing a seed layer of immobilized nanoparticles on a substrate provides a well-adhered nucleated layer to produce a reliable and uniform electroplated metal film.

According to another aspect of the preferred embodiment, a metal can be selectively deposited on a predetermined region or regions of a substrate. The enabling electrochemical characteristics according to this aspect of the preferred embodiment is discussed below with respect to FIGS. 3-4.

Figure 3A:
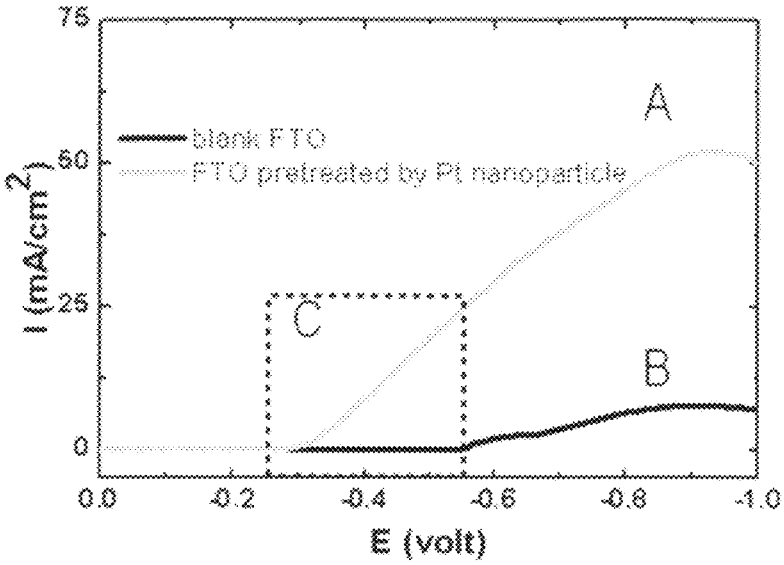
FIGS. 3A-3B depict a cathodic waveform and a series of photographs that demonstrate selective metal depositions according to the invention.

FIG. 3A depicts two cathodic waveforms that result from performing the analytical technique of cyclic voltammetry for electroplating tin on a FTO substrate. The analytical technique of cyclic voltammetry is typically used to confirm the electrochemical properties of the metal electrolyte in the electroplating solution. Here, a Gamry PCI4/300 potentistat/galvanostat can be used in the electrochemical measurements in a standard three-electrode system having a platinum mesh as the counter electrode and a saturated calomel electrode (SCE) as the reference electrode.

As shown in FIG. 3A, waveform A illustrates the electrochemical measurements of electroplating tin with a seed layer of platinum nanoparticles, and waveform B illustrates the electrochemical measurements of electroplating tin without the seed layer. As shown, the current-potential curve of tin on pretreated FTO glass (waveform A) is less negative than the current-potential curve on a untreated surface (waveform B).

The seed layer of nanoparticles deposited on FTO serve as nucleation sites to raise the surface energy such that when the metal atoms are deposited onto the nanoparticles, the total surface energy can be reduced. Therefore, the seed layer of deposited nanoparticles cause the current-potential curve on a pretreated substrate to be less negative than an untreated substrate. This allows the metal atoms to more strongly adhere to the substrate rather than to each other.

Figure 5A:
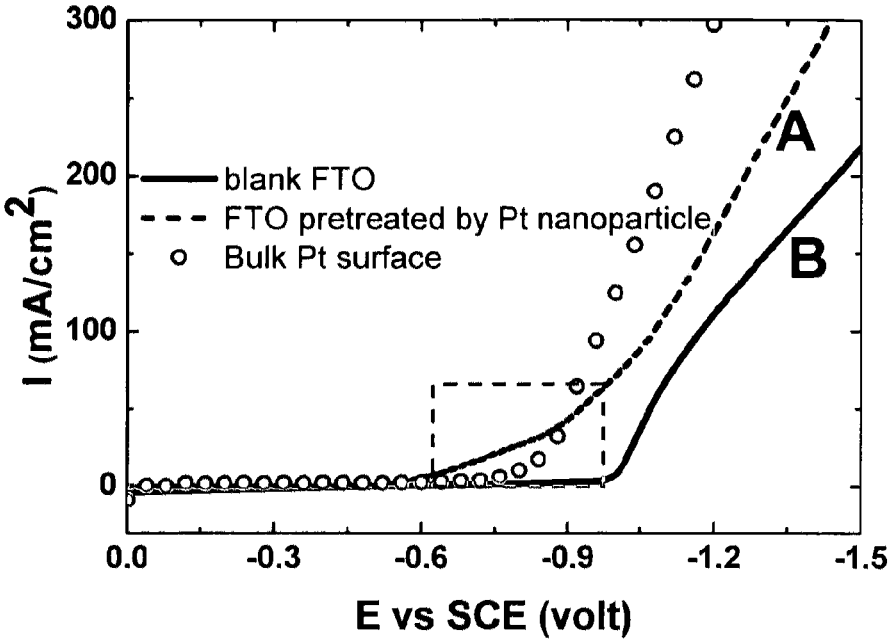
FIGS. 5A-5C depict a series of cathodic waveform that demonstrate the selective deposition of various metals according to the invention.

As shown in FIG. 3A, a region defined by a dash box C illustrates an operational window for selective deposition in a predetermined region or regions of a substrate that can be pretreated with a seed layer of nanoparticles. For example, as shown in FIG. 3A, electroplating tin on an untreated FTO surfaces requires a larger onset potential of $E_{onset}$=−0.55 V to initiate deposition when compared with electroplating the same on a FTO surface pretreated with nanoparticles ($E_{onset}$=−0.27 V). As another example, as shown in FIG. 5A, electroplating nickel on a untreated FTO surfaces requires a larger onset potential of $E_{onset}$=−1.0 V to initiate deposition when compared with electroplating the same on a FTO surface pretreated with nanoparticles ($E_{onset}$=−0.53 V).

Figure 3B:
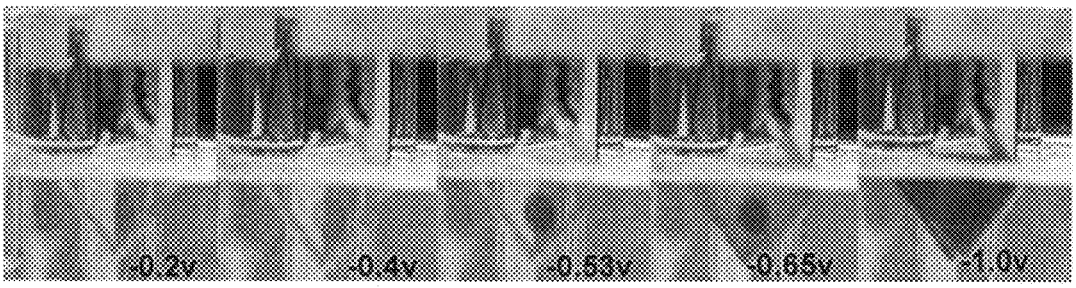

Accordingly, various electroplating voltage conditions are shown in FIG. 3B. In particular, a circular region of a FTO substrate can be deposited with a layer of nanoparticles, and the substrate can be electroplated with tin at various voltage levels, i.e. −0.2V, −0.4V, −0.53V, −0.65V, and −1.0V. As shown, electroplating under voltages that fall within the voltages defined by the dash box C in FIG. 3A exhibits selective metallization in the circular region. In contrast, outside the operational window as defined by dash box C in FIG. 3A, metallization either fails to occur (−0.2V) or occurs without selectivity (−1.0V).

Therefore, a method of selective metal deposition is provided according to another aspect of a preferred embodiment. Specifically, if electroplating is performed within the voltage range of approximately −0.27V and −0.53V, only a selected portion, the circular region, of the glass substrate is metalized with tin.

Figure 4A:
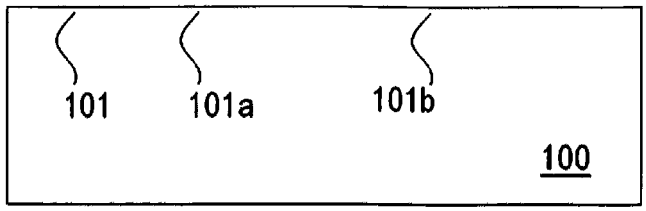
FIGS. 4A-4C depict another method of selective metal deposition according to the invention.
Figure 4B:
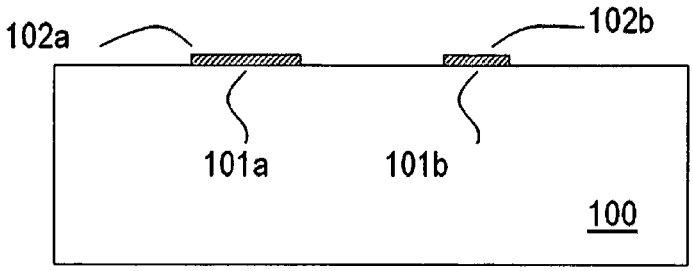
Figure 4C:
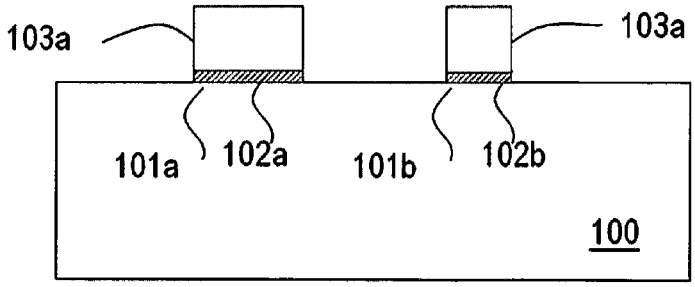

As shown in FIGS. 4A-4C, a metallization layer can be selectively formed by an electroplating process. In particular, predetermined regions 101*a* and 101*b* of a deposition surface 101 of the substrate 100 are selected for electro-deposition by a deposition of a seed layer. As shown in FIG. 4A, a number of processes can be used to selectively deposit a surfactant film, including photolithography, screen printing, inkjet technology, microcontact stamp printing, dip-pen nanolithography, and electrochemical imprinting.

Next, as shown in FIG. 4B, the deposition surface 101 can be pretreated by depositing a seed layer of nanoparticles 102*a* and 102*b* in predetermined regions 101*a* and 101*b*, respectively.

Next, the pretreated deposition surface 101 and the seed layer 102*a* and 102*b* of nanoparticles thereon are annealed to sinter the seed layer of nanoparticles. According to a preferred embodiment, the pretreated deposition surface 101 can be annealed at 250° C. for 10 minutes at ambient conditions to sinter the platinum nanoparticles and to burn away the protective PVP-polymers.

Next, as shown in FIG. 4C, a metal can be electroplated onto the pretreated deposition surface 101 to form a metallization layer 103*a* and 103*b*. According to a preferred embodiment, Nickel can be electroplated onto the pretreated deposition surface 101 within an optimum range of the operating voltage from a commercial electrolyte at 53° C. Other metals can be electroplated onto the pretreated deposition surface, for example, copper, tin, and gold can be similarly electroplated onto to pretreated substrate surface 101 at room temperature.

Figure 5B:
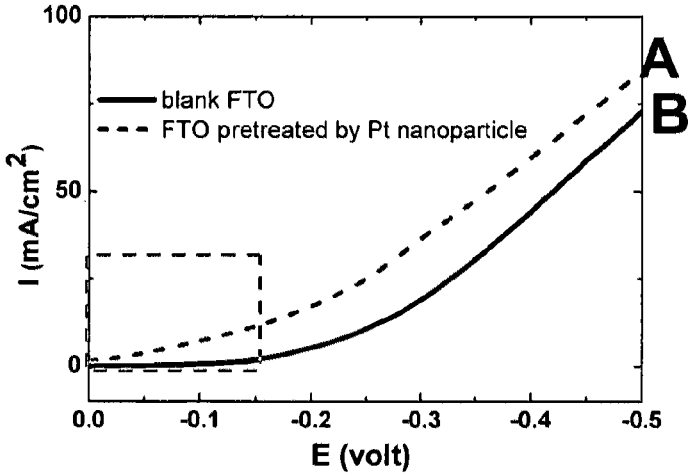
Figure 5C:
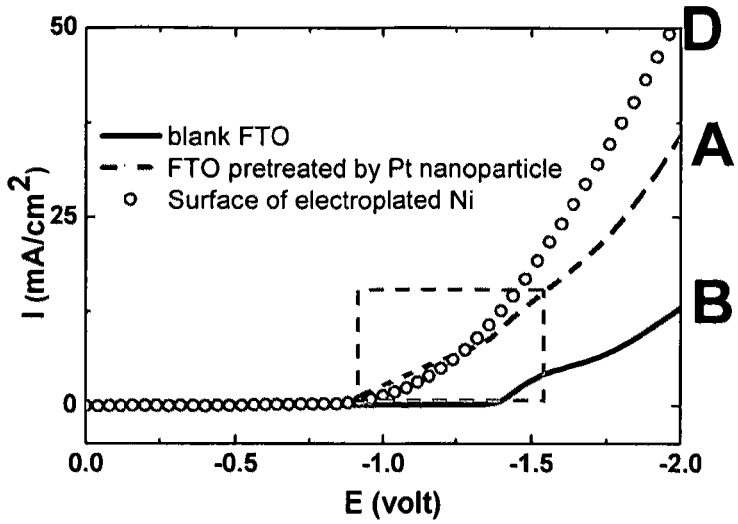

A similar trend can be found in electroplating nickel, copper, and gold, shown in FIGS. 5A-5C, respectively. Nickel electrodeposition onto a bulk platinum surface requires a less negative onset potential (−0.75V) (FIG. 5A) compared to the blank FTO surface (−1.0V), which indicates that atomic clusters bond more strongly on platinum. Furthermore, nickel deposited on platinum nanoparticles has less negative onset potential (−0.53 V) than that on bulk platinum surface. This underpotential is because nano-sized platinum particles have high surface energy, and thus serve as nucleation sites for atomic clusters to preferentially deposit on them to reduce the total surface energy. The deposited atoms will be more strongly bound to the nanoparticles which were strongly immobilized onto substrate, leading to stronger adhesion.

As discussed above, similar operational windows are provided for other electroplating metals. Accordingly, FIGS. 5A-5C depict waveforms for nickel, copper, gold, respectively. Specifically, in each of FIGS. 5A-5C, waveform A illustrates the electrochemical measurements of electroplating the respective metal with the seed layer of platinum nanoparticles, and waveform B illustrates the electrochemical measurements of electroplating the respective metal without the seed layer. And the dash boxes illustrate operational windows for selective metallization of the respective metals.

Furthermore, as shown in FIG. 5C, waveform D corresponds to the electrochemical measurements during gold deposition onto nickel which was originally electroplated on the nanoparticle regions. As shown, it is also more positive when compared with electroplating gold on an untreated FTO substrate. Thus a second operational window for the subsequent selective electroplating of gold is provided, and a double-layer structure can be achieved. It is understood that other metal can be electroplate instead or in addition to gold.

Figure 5D:
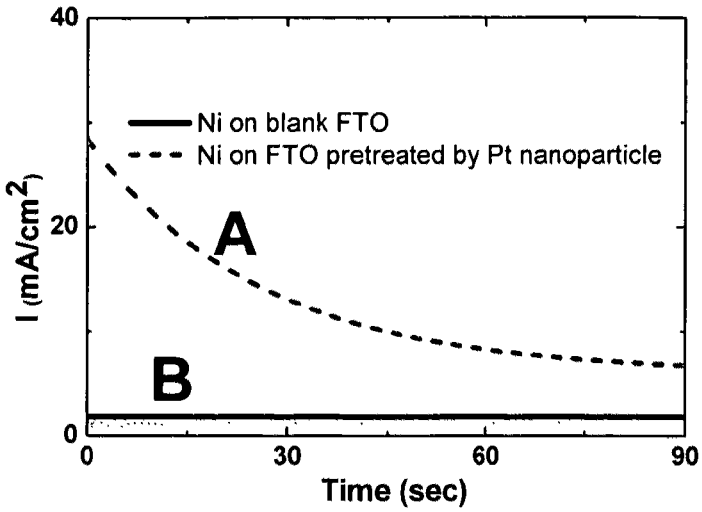
FIGS. 5D-5E depict chronoamperograms of the selective deposition of various metals according to the invention.
Figure 5E:
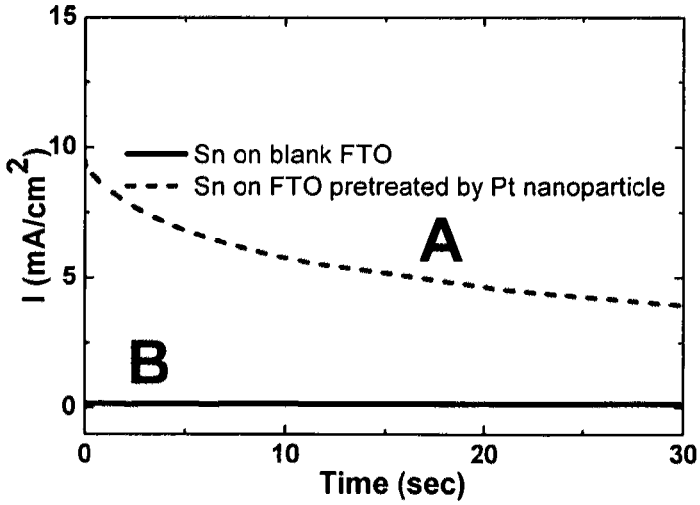

According to another aspect of preferred embodiment, optimum temporal parameters are provided for the electroplating process, and is discussed below with respect to FIGS. 5D and 5E. As shown in FIG. 5D, a chronoamperograms can be obtained to confirm the current response to the optimum operating voltage at −0.8 V for electroplating nickel on pretreated FTO (waveform A) and untreated FTO (waveform B). In particular, waveform A shows an average rate of electroplating nickel on FTO with the Pt nanoparticle treatment can be about 0.2 μm/min (as measured by a profilometer). In contrast, almost no faradic current can be detected for electroplating on untreated FTO, which confirms that no substantial deposition has occurred. Similarly, as shown in FIG. 5E, a consistent results is seen in the chronoamperograms for electroplated tin under operating voltage of −0.4 V.

According to another aspect of the preferred embodiment, a wide range of optimum concentration and deposition time are provided for desirable metal deposition. As shown in FIGS. 11A-11L, SEM images are taken for of nickel electroplating nickel at various time durations and with various concentrations of nanoparticle solutions. Specifically, FIGS. 11A, 11B, 11C, and 11D depict electroplating nickel for durations of 0 second, 5 seconds, 15 seconds, and 30 seconds on untreated FTO surfaces; FIGS. 11E, 11F, 11G, and 11H depict electroplating nickel for durations of 0 second, 5 seconds, 15 seconds, and 30 seconds on FTO surfaces pretreated by platinum nanoparticles; and FIGS. 11I, 11J, 11K, and 11L depict electroplating nickel for durations of 0 second, 5 seconds, 15 seconds, and 30 seconds on FTO surface pretreated with a solution of 20% diluted platinum nanoparticles. These SEM images confirm that a substantially uniform application of nanoparticles, which provide uniform nucleation sites, can be obtained with solutions of a wide range of concentrations of nanoparticles.

Figure 5F:
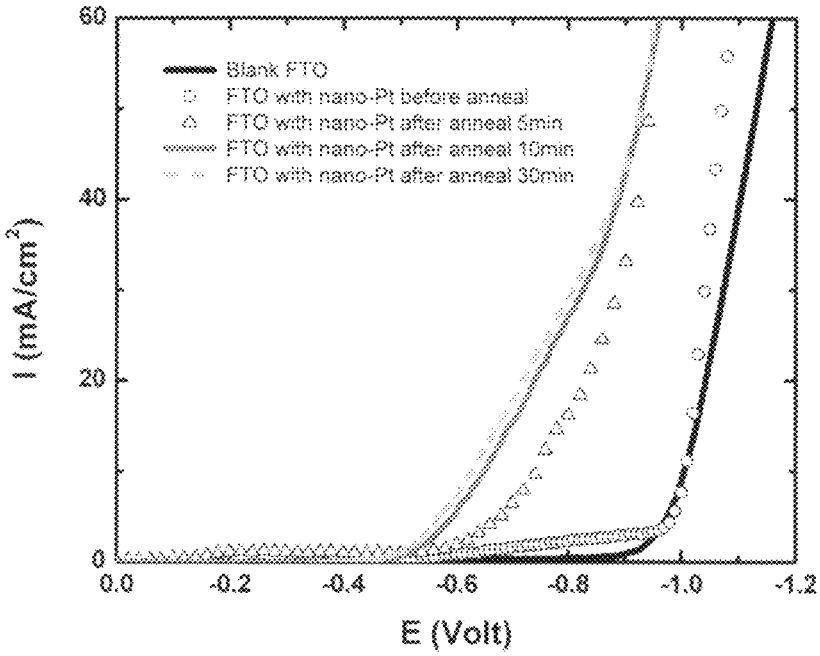
FIG. 5F depicts a cathodic waveform of the annealing process according to the invention.

According to another aspect of the preferred embodiment, optimum temporal parameters are provided for the annealing step. As shown in FIG. 5F, a cathodic waveform cyclic voltammetry is obtained for nickel electroplated on FTO with platinum nanoparticles treated by various annealing times. As shown, electroplating on a nanoparticle-pretreated surface before annealing occurs at the same onset potential of electrodeposition on untreated FTO surface. The reason could be the poor contact between nanoparticles and substrate caused by the existence of the protective PVP-polymer and conditioner resulting in higher charge-transfer resistance. If annealing is performed for over 10 minutes at 250° C., the protective PVP-polymer and conditioner can be burned away so that the current-potential curve moved forward less negative and opened up a window of selective electroplating.

It is also observed that nanoparticles on FTO without annealing can be wiped off while no obvious nanoparticles being wiped off after annealing. Puff-off test also showed that insufficient annealing time would cause poor bonding between the nanoparticles and the substrate leading to coating came off.

Figure 6A:
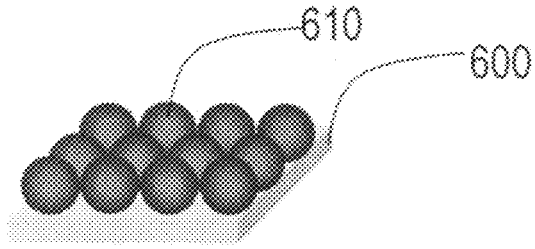
FIGS. 6A-6G depict another method of selective metal deposition according to the invention.

FIGS. 6A-6G depicts a second embodiment for selective metallization. According to the second embodiment, a low-cost technique based on self-assembled polystyrene microspheres can be used to pattern a highly-ordered dot arrays on a substrate 600, in order to selectively metallize a portion of the substrate surface. As shown in FIG. 6A, a monolayer of polystyrene microspheres 610 can be selectively deposited in predetermined regions on a FTO substrate 600. In particular, a self-assembled monolayer of 1.5 μm polystyrene microspheres on an aqueous surface can be transferred onto the FTO substrate surface.

Figure 6B:
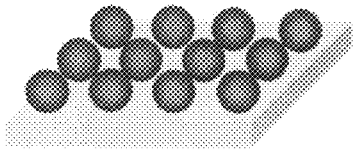

Next, as shown in FIG. 6B, the diameters of the polystyrene beads are tailored by a process of inductively coupled plasma reactive ion etching (ICP-RIE) with oxygen. In particular, the diameters of the polystyrene beads can be tailored by ICP-RIE with 50 sccm of oxygen and 5 sccm of tetrafluoromethane at a pressure of 100 mTorr and radio frequency (RF) power of 100 W with 480 s of etch time.

Figure 6C:
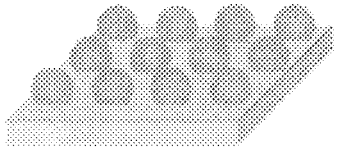

Next, as shown in FIG. 6C, a 150 nm layer of copper can be deposited by an e-beam evaporation at room temperature. The 150 nm Cu layer acts as a sacrificed mask.

Figure 6D:
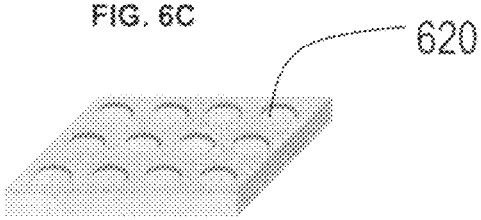

Next, as shown in FIG. 6D, the monolayer of polystyrene spheres 610 can be removed by ultrasonication in tetrahydrofuran. The result is a plurality of holes 620 in the 150 nm copper layer in the predetermined regions.

Figure 6E:
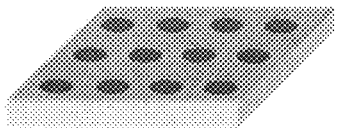
Figure 6F:
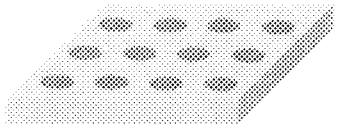

Next, as shown in FIG. 6E, the substrate 600 can be immersed into a solution of 1% ML-371 at 45° C. for 5 min. Immediately after, as shown in FIG. 6F, the substrate can be immersed into a solution of PVP-capped platinum nanoclusters suspension (pH=2.3) at room temperature for 5 min and then annealed at 250° C. for 15 min. A nanoparticle dot-pattern can be self-aligned on the FTO substrate surface wherein the platinum nanoparticles are adhered by the ML-371 surfactant on the predetermined regions of the substrate surface exposed by the plurality of holes 620. The Cu layer can be simultaneously dissolved in the acid PVP-Pt solution. The patterned seed layer of nanoparticles can be then immobilized on the substrate by the annealing process.

Figure 6G:
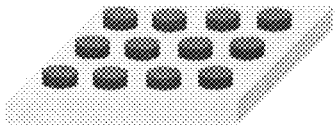

Finally, as shown in FIG. 6G, a desired material, typically a metal, can be selectively electroplated onto the substrate 600 at predetermined regions at an operating voltage within the optimum range.

Figure 7A:
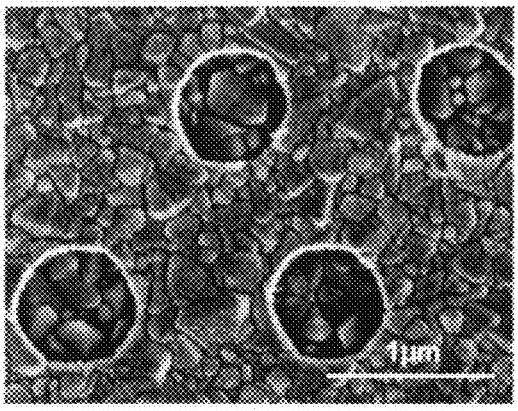
FIGS. 7A-7F are scanning electron microscope (SEM) and AFM images confirming a selective metal deposition according to the second embodiment.
Figure 7B:
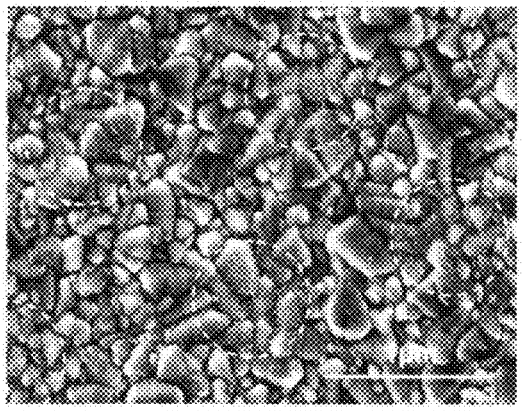
Figure 7C:
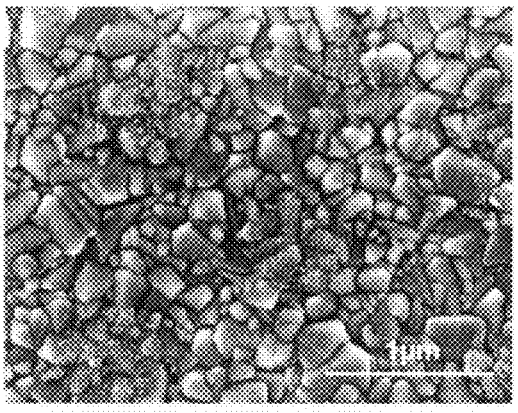
Figure 7D:
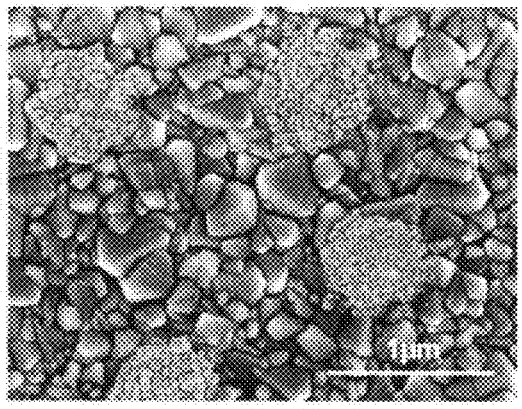
Figure 7E:
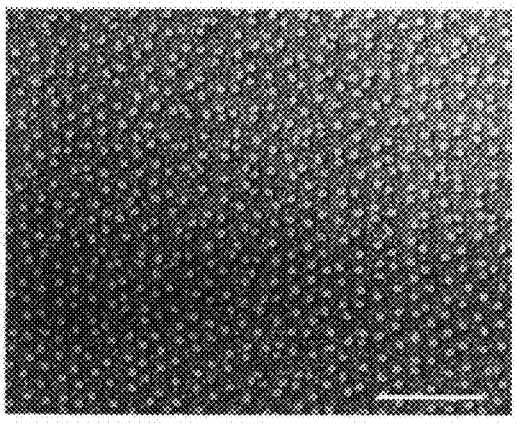
Figure 7F:
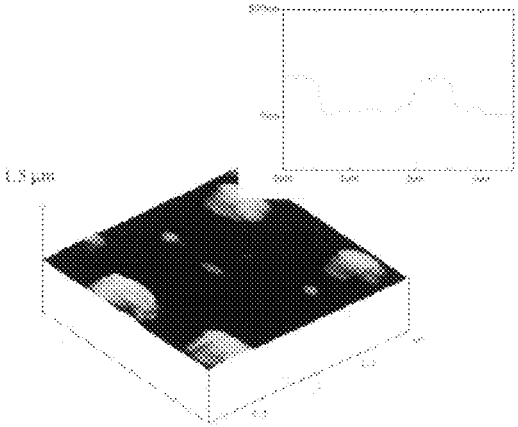

The results of the above deposition method can be verified through scanning electron microscope (SEM) images. FIG. 7A-7E depict the SEM images of a plurality of predetermined regions selected for metallization. In particular, as shown in FIG. 7A, holes 620 are form in a range of 500 to 700 nm. Shown in FIG. 7B, a nanoparticle dot-patterns can be generated on the substrate 600 after the immersion into the nanoparticle solution and the annealing treatment. As shown in FIGS. 7C and 7D, nickel can be then electroplated at an operating voltage of −0.8 volt for 15 seconds and 60 seconds, respectively, to yield metal islands in the predetermined regions. As shown in FIG. 7E, a dot array of electroplated nickel having an average diameter of approximately 600 nm are formed and are spaced approximately 1 μm apart. FIG. 7F depicts another confirmation of the selective metallization process, as discussed above, through an AFM image and a corresponding line scan of a post-deposition surface pattern, which demonstrate that metal dots having a thickness of approximately 200 nm have been formed cleanly on the FTO substrate surface.

Furthermore, pull-off adhesion tests can be performed. For example, a pull-off adhesion tests for electroplated nickel on FTO glass with the nanoparticle bostontreatment showed that no deposited nickel can be stripped off by a 3M Flatback Masking Tape 250 (ASTM D3359). In contrast, without the nanoparticle treatment, almost all of the deposited nickel on the untreated FTO glass came off.

Figure 8A:
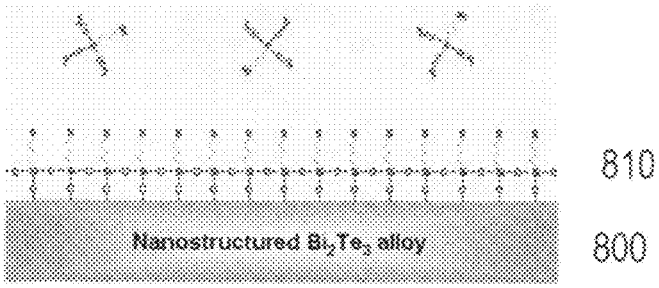
FIGS. 8A-8C illustrate a method of metal deposition on semiconductor substrates for fabricating thermoelectric devices, according to the invention.
Figure 8B:
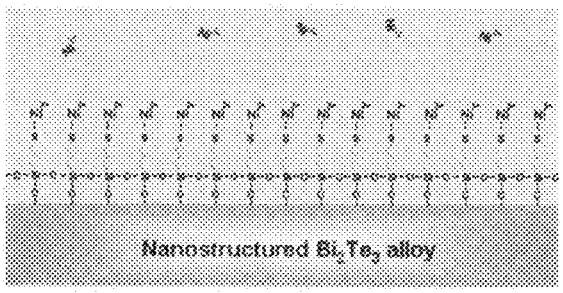
Figure 8C:
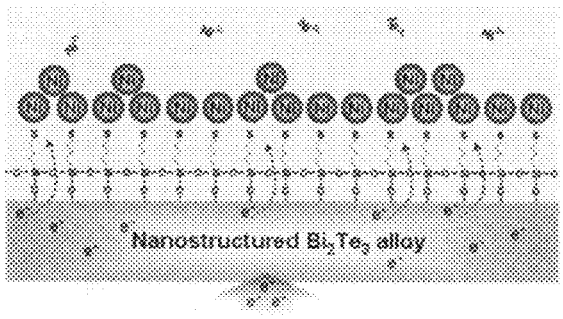

According to a third embodiment, as shown in FIGS. 8A-8C, there is provided a method for forming an electrode during the fabrication of thermoelectric devices or device components. The method described below deposits a seed layer which provides nucleation sites for electroplating metal on nanostructured $Bi_2Te_3$-based alloys in order to form good electrical contacts.

A substrate can be prepared by any number of conventional methods. For example, according to a preferred embodiment, bulk nanostructured $Bi_2Te_3$-based materials, p-type (alloyed with Sb as $Bi_xSb_{2-x}Te_3$) and n-type (alloyed with Se as $Bi_2Se_yTe_{3-y}$) disk samples of 25 mm in diameter and 2 mm in thickness are made by a ball milling and hot pressing method. After hot pressing, both sides of the disk sample are polished using sand paper. To achieve a wettable surface for subsequent metallization, a 1 minute immersion in a 0.5% bromine-ethanol solution at room temperature and a 5 minute immersion in a 5% WAKO CLEAN-100 at 45° C. with sonication are used for surface cleaning.

First, as shown in FIG. 8A, a substrate 800 can be pretreated by a deposition of a functionalized self-assembled monolayer (SAM) 810 of 3-mercaptopropyl-trimethoxysilane (MPS). In particular, the substrate 800 can be immersed into a 1% MPS solution in ethanol for 50 minutes. The general chemical formula for these silane-based self-assembled MPS can be R'—$Si(OR)_3$, where R' is usually a short carbon chain containing some functional groups and OR is a hydrolysable end-group such as ethoxy, methoxy, or chloro group which can react with a hydroxylated surface on the substrate to form silanol (Si—OH) groups.

The silanol groups react with the hydroxyl groups present on the substrate surface to form interfacial covalent bonds. Subsequent adsorptions result in the silanol groups condensing with each other to form a polysiloxane (Si—O—Si) network.

Next, as shown in FIG. 8B, the pretreated substrate surface can be immersed into a metal electrolyte for 30 seconds to form bridging links between the monolayer 810 and the metal ions before electroplating. In particular, the metal electrolyte can be a nickel ion electrolyte.

Here, the functional groups protruding from highly ordered and oriented SAMs produce a specific interaction function. Also, as it was discovered, a SAM is able to transport electrons by a hopping process. Therefore, according to the third embodiment, this hopping process can be combined with the nucleation function of the seed layer in the electroplating process by arranging a hydrolysable end-group and bridging functional group on SAMs.

As shown in FIG. 8B, the SAM adheres to the semiconductor substrate 800 and its functional group forms a bridging link to metal ions ($Ni^+$) in the electrolyte. According to the preferred embodiment, MPS with methoxy end-groups and a sulfur functional group can be used to form a SAM on nanostructured $Bi_2Te_3$-based alloys. Furthermore, the silane-based MPS can be characterized according to conventional spectroscopic techniques such as the Auger electron spectroscopy (AES). For examples, the reference Surface Characterization Using AES for Silane provides a description of such technique. Additionally, a further advantage of MPS can be that it forms a neutral solution in alcohol, thereby avoiding oxidation and corrosion to the substrate.

Next, as shown in FIG. 8C, a predetermined metal can be electroplated onto the pretreated substrate surface within an optimum range of the operating voltage. Here, nickel can be electroplated. A second metal can be optionally electroplated to achieve a desired electrical, chemical, or mechanical characteristic for the contact (not shown). For example, gold can be electroplated on the electroplated nickel to form a second metallization layer.

Figure 9A:
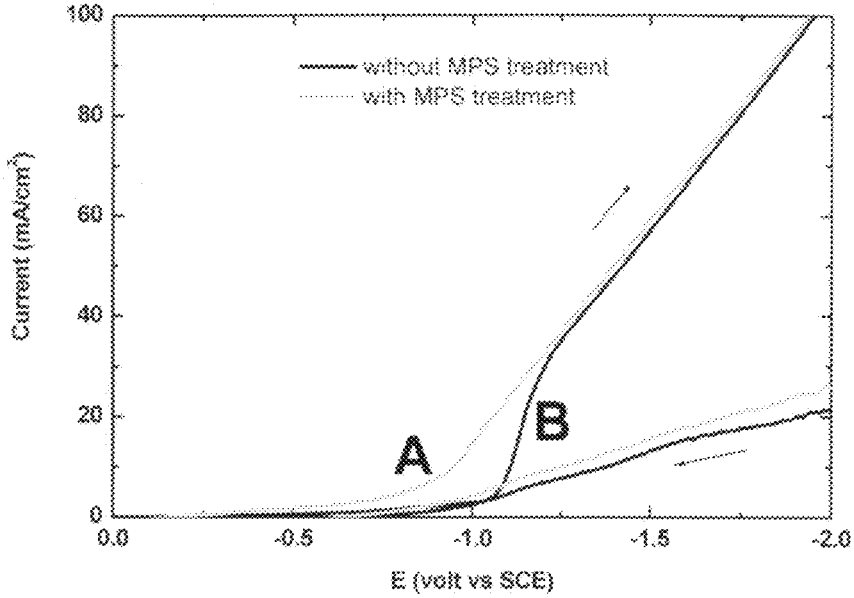
FIGS. 9A-9B depict a cathodic waveform and a chronoamperogram during a metal deposition performed according to the method shown in FIGS. 8A-8C.

Next, FIG. 9A depicts two cathodic waveforms obtained by performing cyclic voltammetry on the process of electroplating nickel on nanostructured $Bi_2Te_3$-based alloys with a pretreatment as discussed above (waveform A), and for electroplating nickel without the pretreatment (waveform B). Here, a Gamry PCI4/300 potentistat/galvanostat can be used in the electrochemical measurements in a standard three-electrode system with a platinum mesh as the counter electrode and a saturated calomel electrode (SCE) as the reference electrode.

As shown in FIG. 9A, the current-potential curve of electroplating nickel on a pretreated substrate surface is more positive (waveform A) than the current-potential curve of electroplating nickel on an untreated substrate surface (waveform B). Here, the pretreatment of the MPS monolayer provides nucleation for electroplating metal, which can determined by the formation energy, excess energy, and internal strain. Accordingly, the MPS monolayer with a bridging sulfide group provides more nucleation sites to increase the binding energy between metal nucleus clusters and the substrate. This increase in binding energy decreases the excess energy needed for electroplating nucleation, making the potential more positive (UPD).

Therefore, nickel atoms more strongly adhere to a nanostructured $Bi_2Te_3$ surface that is pretreated with a MPS monolayer. In contrast, the nickel atoms would more strongly adhere to each other than to an untreated nanostructured $Bi_2Te_3$-based alloy. The rather high excess energy of electroplating nucleation corresponds to an instantaneous nucleation model, where the growth of nuclei on a small number of active sites, such as crystal defects, atomic step or impurities, occurs in a very short time period. These nucleation sites grow into three-dimensional islands and then coalesce (Volmer-Weber growth). Island growth during electroplating nucleation is usually not desirable for technological applications due to its poor adhesion and non-uniform deposition.

Pull-off adhesion tests using 3M Flatback Masking Tape 250 (ASTM D3359) also showed that no coating was stripped off for a 1 μm layer of electroplated nickel on nanostructured $Bi_2Te_3$-based alloys with the MPS treatment, but almost all of the coating on the untreated nanostructured $Bi_2Te_3$-based alloy came off.

Figure 9B:
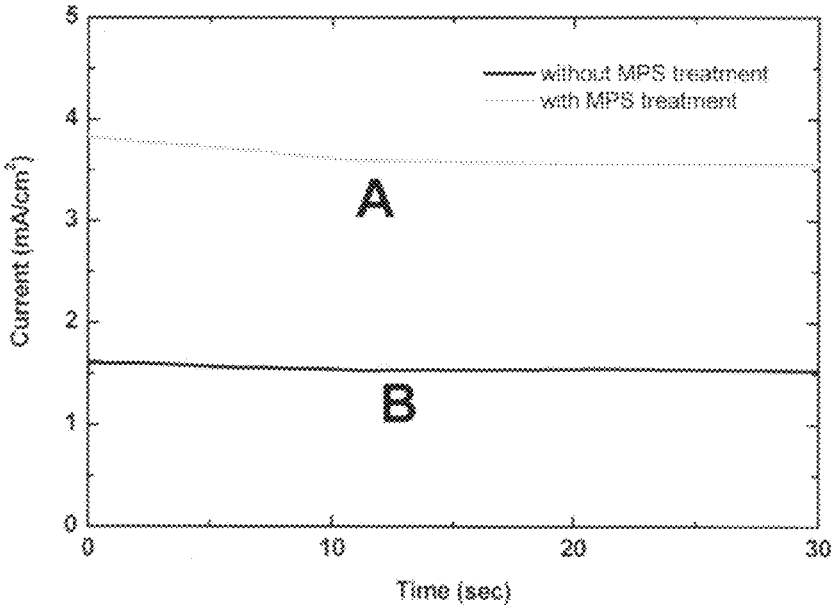
Figure 11A:
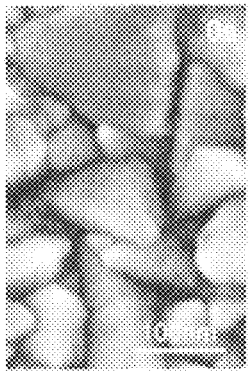
FIGS. 11A-11L depict SEM images of metal deposition with various concentrations of nanoparticle seed layers, according to the invention.
Figure 11B:
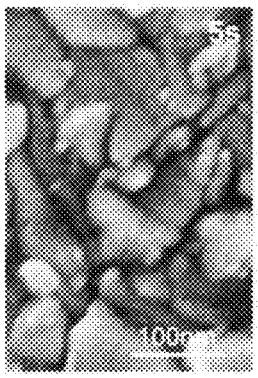
Figure 11C:
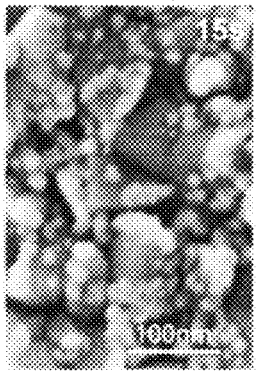
Figure 11D:
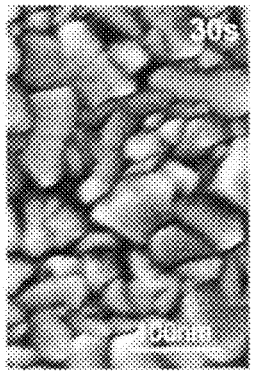
Figure 11E:
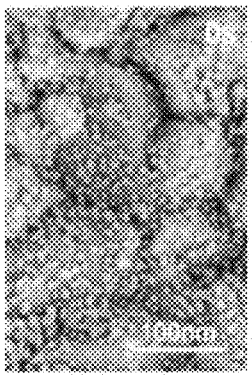
Figure 11F:
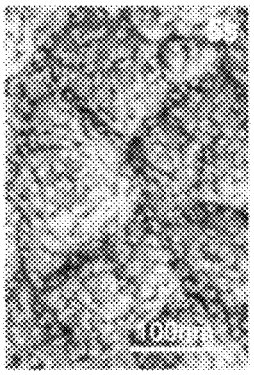
Figure 11G:
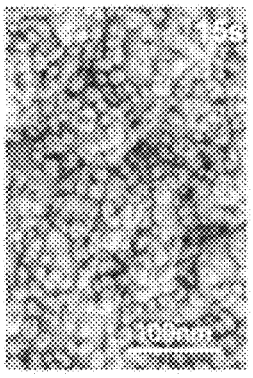
Figure 11H:
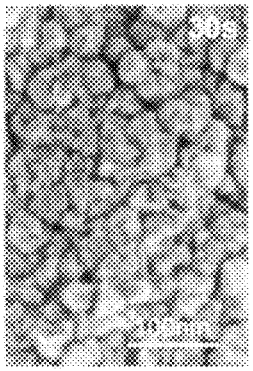
Figure 11I:
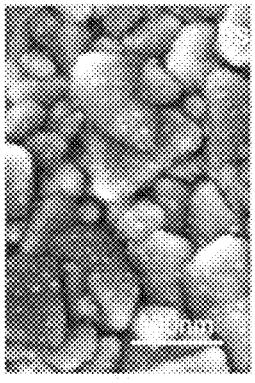
Figure 11J:
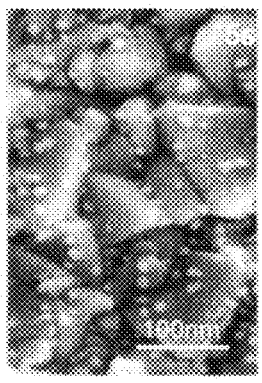
Figure 11K:
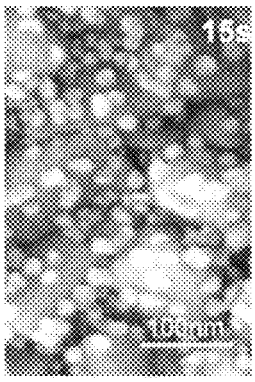
Figure 11L:
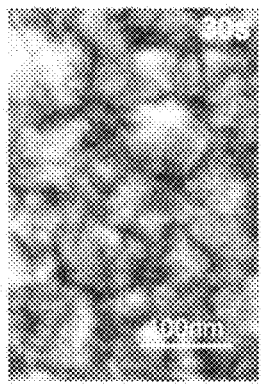

As shown in FIG. 9B, a chronoamperograms can be obtained to show that the current response to the optimum operating voltage at 0.85 volt for electroplating nickel on nanostructured $Bi_2Te_3$-based alloys with a MPS monolayer treatment (waveform A) and without a MPS monolayer treatment (waveform B). As shown, the rate of electroplating can be 2.5 times faster in the case of a MPS monolayer treatment.

Further as confirmation of the metal deposition method described above, shown in FIG. 10A, an AFM image can be obtained for a 1 μm thick layer of electroplated nickel on an untreated nanostructured $Bi_2Te_3$-based alloy. The AFM can be used to scan the surface and to calculate a root mean square (RMS) roughness, where a random distribution of only a few active sites would cause irregularities in the grain size and increase film roughness. Here, uneven grain growth also leads to stacking faults thereby increases film stress and strain due to mismatch in the lattice spacing. Therefore, the poor adhesion can be understood in terms of weak interface contact and the large strains and stresses in the electroplated film.

As shown in FIG. 10B, a RMS roughness can be reduced from 21.7 nm to 9.4 nm over a 25 $\mu m^2$ area when a MPS monolayer is deposited as a seed layer for nickel electroplating. Here, 1 μm electroplated nickel films on substrate surfaces with a MPS monolayer treatment is compared to one that results without a MPS monolayer treatment by SEM observations (FIGS. 10C and 10D, respectively).

As shown in FIG. 10C, on an untreated substrate surface, secondary nucleation atoms must travel towards each other on a small number of nucleation sites in order to minimize surface energy. Islands then grow to form a porous and irregular structure. In contrast, a complete coverage by a dense and conformable nickel film can be seen in FIG. 10D for a substrate surface that is treated with the MPS monolayer.

Furthermore, according to a preferred embodiment, a method of fabricating stable and low-resistance ohmic contacts is provided. In order to form the desired contact, a low ohmic contact at each end of the $Bi_2Te_3$-based alloys requires a resistance of about 1×10-6 ohm-cm$^2$, which represents approximately 1 percent of the total resistance. Under this condition, the impact of contact resistance can be safely neglected and the ratio of $ZT_{eff}$ to ZT equals to unity.

Table 1 (below) shows data of electrical contact resistance measured by a 4-wire AC method (Keithley 2300) for small cubes cut from a disk of n-type or p-type nanostructured $Bi_2Te_3$, both sides of which are treated by a MPS monolayer followed by electroplating a 1 μm layer of nickel and a 1 μm layer of gold. A small current (Joule heating can be neglected) with alternating polarity under a high frequency of 1000 kHz (the Peltier heat cancels due to periodic heating and cooling at the junction) from 0.03 mA to 0.1 mA was input into the sample from the top to the bottom. Total resistance can be obtained by the slope of the voltage drop and the current. The intrinsic resistance of nanostructured $Bi_2Te_3$ alloys can also be obtained by measuring the voltage drop across the sample body itself using a known distance. Therefore, the electrical contact resistance for both sides is the difference between total resistance and intrinsic resistance.

As shown in Table 1 below, the specific contact resistance of electroplated nickel/MPS/nanostructured $Bi_2Te_3$ alloys can be approximately 1×10-6 Ωcm$^2$ and contributes around 1% of the total resistance. Thus, the contact resistance can be safely neglected and an ohmic contact is provided.

TABLE 1

| Type | No. | Length (mm) | Width (mm) | Height (mm) | BiTe Resistivity (Ohm cm) | Total Rs (Ohm) | Specfic Contact Rs (Ohm cm$^2$) | Contact/Total (%) |
|---|---|---|---|---|---|---|---|---|
| N | 1 | 1.07 | 1.06 | 1.54 | 1.29E−03 | 1.76E−02 | 8.79E−07 | 0.89 |
| | 2 | 1.11 | 0.96 | 1.52 | 1.04E−03 | 1.48E−02 | 4.21E−07 | 0.54 |
| | 3 | 1.21 | 1.21 | 1.48 | 1.08E−03 | 1.09E−02 | 2.92E−07 | 0.37 |
| | 4 | 1.07 | 1.26 | 1.56 | 1.23E−03 | 1.44E−02 | 1.07E−06 | 1.11 |
| P | 1 | 0.89 | 1.01 | 1.48 | 1.17E−03 | 1.95E−02 | 1.02E−06 | 1.18 |
| | 2 | 1.13 | 1.19 | 1.54 | 1.10E−03 | 1.27E−02 | 6.88E−07 | 0.81 |
| | 3 | 1.20 | 1.20 | 1.69 | 1.00E−03 | 1.19E−02 | 9.90E−07 | 1.17 |
| | 4 | 0.80 | 1.23 | 1.50 | 1.18E−03 | 1.82E−02 | 1.17E−06 | 1.32 |

Therefore, a method is provided for depositing an adhesive and uniform metallic layer onto a nanostructured $Bi_2Te_3$-based material. This method results in improved electrical and thermal conductivity at lower cost and higher throughput. Unlike sputtering, the deposition of MPS SAMs on a substrate can be achieved using a wet process, which can be significantly more cost effective. The thin MPS monolayer not only provides a good adhesive layer but also sufficient nucleation sites for electroplating, thereby improving adhesion and uniformity. Measurements of contact resistance and the device efficiency for a solar thermoelectric power generator are also confirmed to yield results of similar quality compared with those created conventional methods.

The new method has many distinct advantages over existing processes during the metallization step and would be applicable in the manufacturing of various substrates. One utility of this method can be the fabrication of metallic electrodes onto other thermoelectric materials, such as lead telluride, zinc telluride, and so on. Other examples include electroplating metals on conductive glass and other low-roughness ceramics for solar panels, light emitting diode (LED) wafers, and the solder bumping process. Additionally, some SAMs, such as octadecyl trichlorosilane (OTS), can be used for nanolithography by localized probe oxidation via AFM, STM or electrochemical methods. By integrating bridging-function SAMs and nanolithography SAMs, other potential applications include the creation of patterned electrically driven sensing surfaces, glass circuit boards for high density electronics packaging, microscale resistive heaters, transparent micro/nanoelectrodes, and surfaces where spatially patterned work functions could serve as templates for subsequent patterning.

The invention claimed is:

1. A method of forming a conductive metal contact on a substrate, comprising:

selectively applying a seed layer on a portion of the surface, wherein this step comprises:

applying a layer of polymeric particles in an array pattern on the substrate to cover a portion of the surface;

depositing a mask layer onto the polymeric particles and substrate surface;

removing the layer of polymeric particles thereby exposing the portion of the surface of the substrate according to the array pattern;

applying a seed layer of nanoparticles onto the remaining portions of the mask layer and the exposed regions of the substrate surface; and removing the mask layer by dissolving the mask layer with an acidic solution, thereby removing a portion of the seed layer adherent to the mask layer but preserving another portion of the seed layer applied to the substrate according to the array pattern; and preferentially depositing an electrically conducting metal onto the selectively applied seed layer by electroplating whereby the nanoparticles serve as nucleation sites for metal deposition.

2. The method of claim 1, wherein the method further comprises:

applying the nanoparticles as a complex with an immobilizing carrier; and annealing the complex to apply the nanoparticles onto the surface of the substrate.

3. The method of claim 2, wherein the annealing step further comprises sintering the nanoparticles onto the surface of the substrate.

4. The method of claim 2, wherein the depositing step further comprises applying a complex of polymer encased nanoparticles.

5. The method of claim 4, wherein the complex comprises at least one polymer selected from the group of poly(vinylpyrrolidone) (PVP), poly(acrylamide) (PAM), poly(vinyl alcohol) (PVAL), poly(acrylic acid) (PAA), and poly(ethyleneimine) (PEI).

6. The method of claim 4, wherein the nanoparticles comprise metal nanoparticles.

7. The method of claim 6, wherein the metal nanoparticles comprise at least one metal selected from the group of platinum, gold, palladium, ruthenium, silver, or nickel.

8. The method of claim 1, wherein the method further comprises contacting the substrate with a surfactant prior to depositing the seed layer.

9. The method of claim 8, wherein the surfactant further comprises at least one cationic surfactant.

10. The method of claim 1, wherein the substrate is characterized by at least one of low surface energy, poor wettability, a hydrophobic surface, a glass material, low surface roughness.

11. The method of claim 1, wherein the step of preferentially depositing the electrically conducting metal further comprises selecting a voltage at which electrically conduction material is preferentially deposited on the selectively applied seed layer.

12. The method of claim 1, wherein the polymeric particles are self-assembled polystyrene microspheres.

13. The method of claim 1, wherein the mask layer is a layer of copper.

14. The method of claim 1, wherein the step of applying a seed layer of nanoparticles further comprises applying the nanoparticles as a complex with an immobilizing carrier and annealing the complex to apply the nanoparticles onto the surface of the substrate.

15. The method of claim 1, wherein the step of applying polymeric particles further comprises etching the self-assembled polymer clusters to a predetermined diameter.

* * * * *